US005983841A

United States Patent [19]

Haber

[11] Patent Number: 5,983,841

[45] Date of Patent: Nov. 16, 1999

[54] HEAT EXCHANGER

[75] Inventor: Bernd Haber, Altbach, Germany

[73] Assignee: J. Eberspacher GmbH & Co., Germany

[21] Appl. No.: 08/952,027

[22] PCT Filed: Apr. 2, 1996

[86] PCT No.: PCT/DE96/00625

§ 371 Date: Oct. 7, 1997

§ 102(e) Date: Oct. 7, 1997

[87] PCT Pub. No.: WO96/35084

PCT Pub. Date: Nov. 7, 1996

[30] Foreign Application Priority Data

Apr. 29, 1995 [DE] Germany ..... 195 15 819
May 19, 1995 [DE] Germany ..... 195 18 435

[51] Int. Cl.[6] ..... F28D 7/12

[52] U.S. Cl. ..... 122/17; 165/156

[58] Field of Search ..... 122/13.1, 17, 367.1; 165/156, 164, 169

[56] References Cited

U.S. PATENT DOCUMENTS 3,468,371 9/1969 Menze ..... 165/156
3,730,229 5/1973 D'Onofrio ..... 165/156
4,479,484 10/1984 Davis ..... 122/17
4,588,659 5/1986 Abens et al. ..... 165/156
5,372,185 12/1994 Lannes ..... 122/17
5,537,955 7/1996 Wu ..... 122/13.1

FOREIGN PATENT DOCUMENTS 30 10 078 10/1981 Germany .
38 07 189 9/1989 Germany .
1 233 534 5/1971 United Kingdom .

*Primary Examiner*—Philip H. Leung
*Assistant Examiner*—Gregory A. Wilson
*Attorney, Agent, or Firm*—McGlew and Tuttle, P.C.

[57] ABSTRACT

In a heat exchanger in the shape of a pot, with a frontal connector for a burner or the like, a lateral water inlet in the base and a water outlet in the region of the frontal connector, water flows through both the base and the jacket of the pot during operation. The invention proposes the provision in the base of the pot of water conveying sections, especially in the form of sickle-shaped water guide channels and barriers to ensure a directional water flow, substantially covering the surface of the base of the pot, in order to ensure a uniform temperature distribution on the pot base without the formation of steam bubbles.

21 Claims, 4 Drawing Sheets

HEAT EXCHANGER

Figure 1:
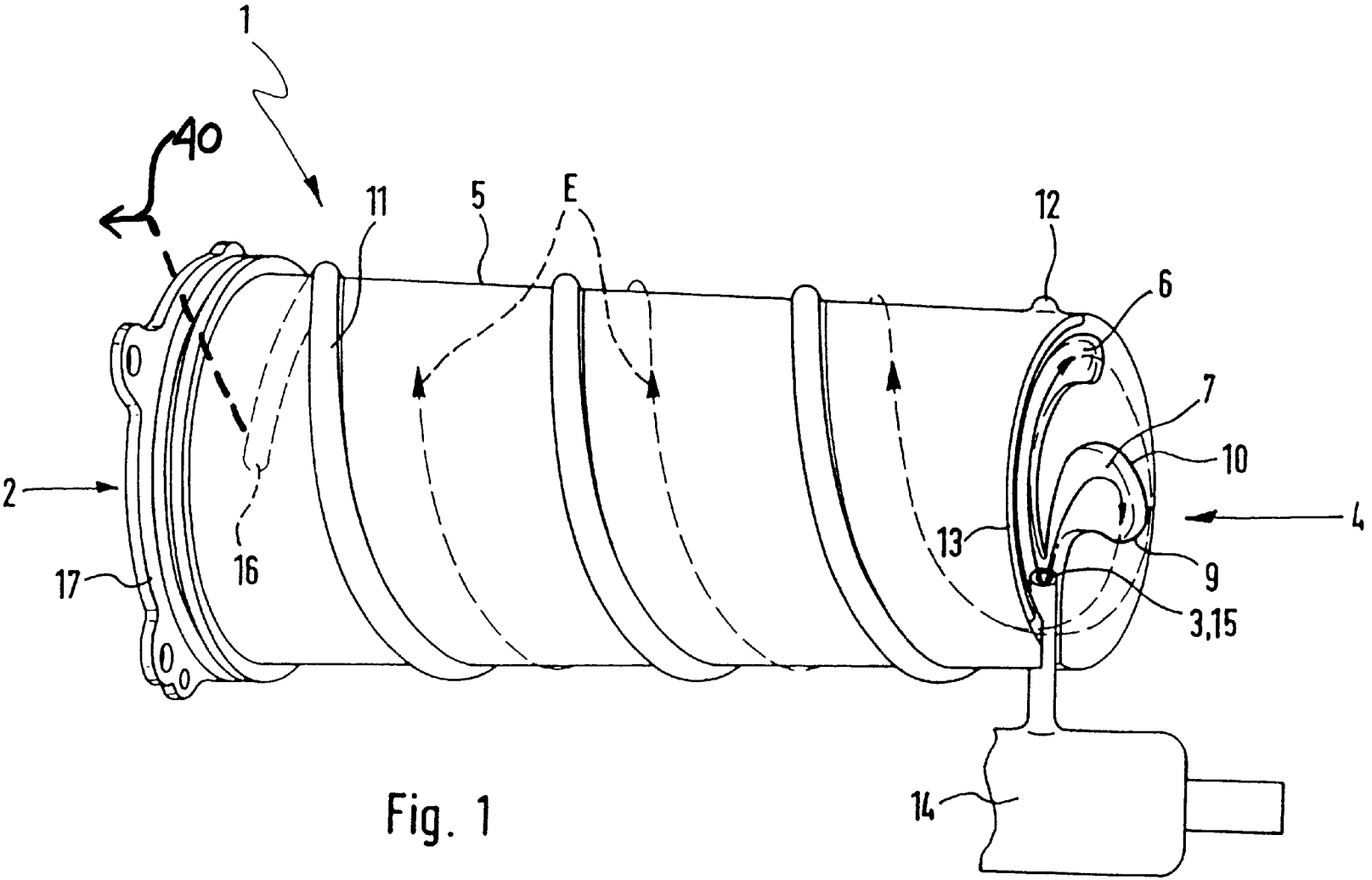

The present invention pertains to a pot-shaped heat exchanger with a front-side connection to a burner or the like for accommodating a burner flame tube, a lateral water inlet in the bottom of the pot and a water outlet in the area of the front-side connection, wherein water flows through both the bottom of the pot and the jacket of the pot.

An above-mentioned, prior-art heat exchanger has, on the underside in the area of the bottom of the pot, a lateral water inlet, into which the water outlet pipe branch of a water pump arranged under the heat exchanger is introduced in a sealed manner to feed the heat exchanger medium in the form of water to both the bottom of the pot and to the jacket of the pot during the operation of the arrangement. The jacket of the pot has a helical water guide to pass the water helically practically over the entire surface of the jacket of the pot before the heated water is removed to the burner for a user at the end of the helix in the area of the front-side connection of the heat exchanger. Even though the water fed in does circulate in the area of the jacket of the pot of the heat exchanger, it does not circulate in the area of the bottom of the pot. A burner flame tube extending into the interior of the pot-shaped heat exchanger may consequently overheat the bottom of the pot, especially at high heat output at a high water outlet temperature close to the boiling point. Local overheated areas of the bottom of the pot lead to the formation of vapor bubbles, which compromise the efficiency of the heat exchanger. In addition, the overheated areas of the bottom of the pot are exposed to an increased stress on the material, which compromises the service life of the heat exchanger.

Based on the above-mentioned state of the art, the object of the present invention is to provide a heat exchanger of the above-described type, which has a simple design and can be operated highly efficiently and makes possible, in particular, a high heat output with a high water outlet temperature.

The basic object of the present invention is accomplished by a heat exchanger of the type described in patent claim 1.

The subject of the present invention is advantageously improved by the features of patent claims 2 through 18.

The essence of the present invention is that water guide sections are provided in the bottom of the pot of the heat exchanger for a directed, essentially surface-covering flow of water in the bottom of the pot.

In the area joining the lateral water inlet, the bottom of the pot has, in particular, at least two water guide channels for a circulating flow of water in the bottom of the pot, which channels have a sickle-shaped top view.

In one variant of the embodiment of the present invention, the water guide channels may be formed by a separate guide plate insert in the bottom of the pot, wherein the guide plates in the bottom of the pot have a sickle-shaped top view and the root of the sickle is located in the area of the lateral water inlet.

In an especially advantageous variant of the embodiment of the present invention, the bottom of the pot has, however, sickle-shaped water guide channels in the form of integrated depressions, wherein the root of the sickle is located in the area of the lateral water inlet.

The radially outermost, sickle-shaped water guide channel preferably has the smallest flow cross section of all water guide channels of the arrangement, wherein the width of this radially outermost water guide channel is maintained at a largely constant value along the sickle.

Radially inwardly located water guide channels preferably have, in contrast, a larger flow cross section, which increases in the direction of the center of the bottom of the pot in the individual water guide channels.

A sickle-shaped water guide channel located radially on the inside preferably extends through the axial center of the heat exchanger or through the center of the bottom of the pot of the heat exchanger.

In an advantageous variant of the present invention, sickle-shaped water guide channels located radially inside have an expansion along the sickle, and this expansion is preferably kidney-shaped.

To support a surface-covering flow over the bottom of the pot, the individual sickle-shaped water guide channels have flat lateral water overflow edges and/or flat water discharge ends, wherein the length of the individual sickle preferably extends over an angle of about 100° of the bottom of the pot. Smaller channels may branch off from these main channels, if necessary.

In a heat exchanger with a helical water guide in the jacket of the pot preferably has—between the lateral water inlet and the beginning of the helical pot jacket water guide—a radially outermost pot bottom edge or a water barrier, which edge (barrier) prevents the water flowing into the bottom of the pot from the water pump from being fed immediately to the heat exchanger jacket, but is first forced to circulate on the pot bottom side over about 360° before the water enters the helical water guide of the jacket of the pot. This water barrier may also be provided, if necessary, along other water guide channels located radially inside.

Like the helical water guide projection on the jacket of the pot, the above-mentioned pot bottom edge may also be integrated within the bottom of the pot, especially if the heat exchanger as a whole is a diecast aluminum part.

In an advantageous variant of the present invention, the pot bottom edge is a separate component, similarly to the variant of the separate guide plate insert in the bottom of the pot, wherein the width of the separate pot bottom edge may be adjusted in a variant. If a small edge width is set, flowing water may splash over the edge. If the edge is higher, extending, e.g., to a stop of the surrounding housing part of the heat exchanger, the total amount of water fed in is forced to pass first through the bottom of the pot in a directed flow.

In another variant of the embodiment of a separate pot bottom edge, the length of the edge, i.e., the length of the jacket arc of the pot bottom edge, may also be adjusted in order to always guarantee that in the case of a water pump, the barrier or the above-mentioned pot bottom edge extends from the water outlet pipe branch to the beginning of the helical water guide.

Finally, another variant of the embodiment is characterized in that the bottom of the pot is slightly arched to the outside.

It is thus achieved due to the present invention that the cooling water fed in is deflected at the bottom of the pot into two or more channels such that a uniform temperature will become established over the entire area of the bottom in a surface-covering manner during the operation of a heat exchanger. Local temperature peaks in the bottom of the pot, which could lead to vapor bubbles, which happens in the state of the art, are consequently absent. Consequently, a high water outlet temperature in the range of the boiling point can be reached due to the present invention in practically all water heaters with high heat output, without vapor bubbles being formed or the material of the bottom of the pot of the heat exchanger being damaged.

A medium other than water may optionally also be used as the liquid heat exchanger medium.

Figure 2:
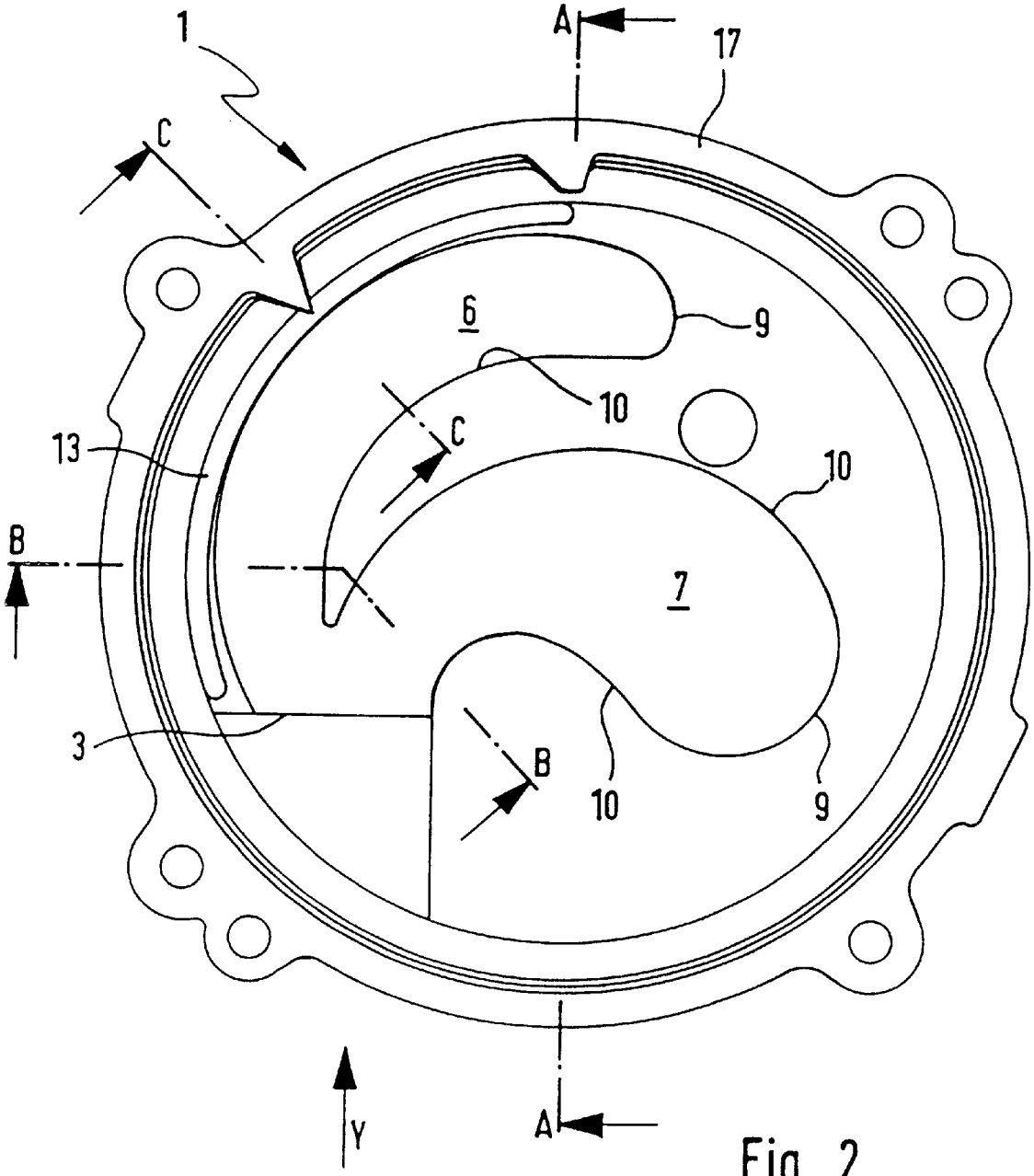
Figure 3:
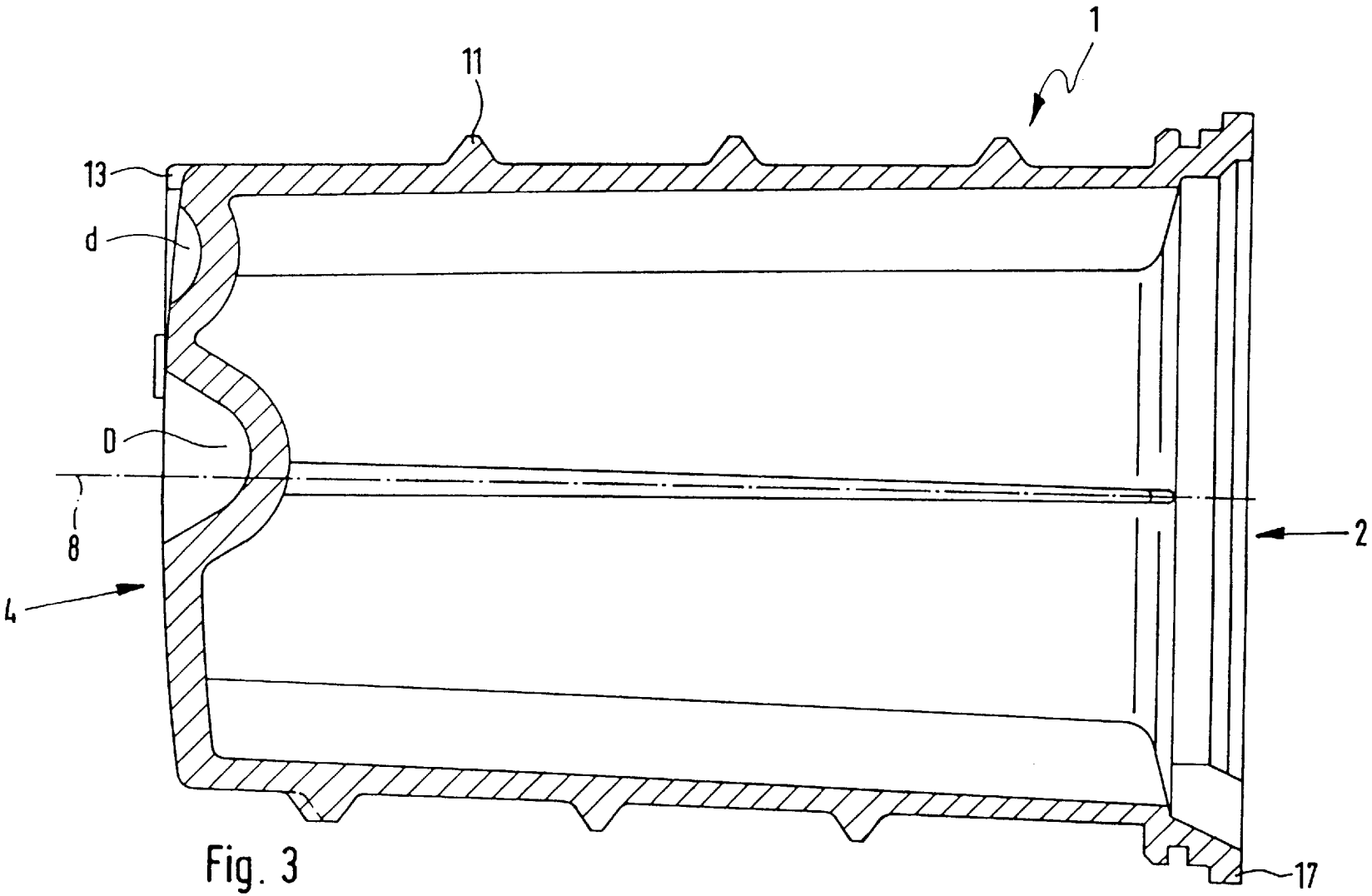
Figure 4:
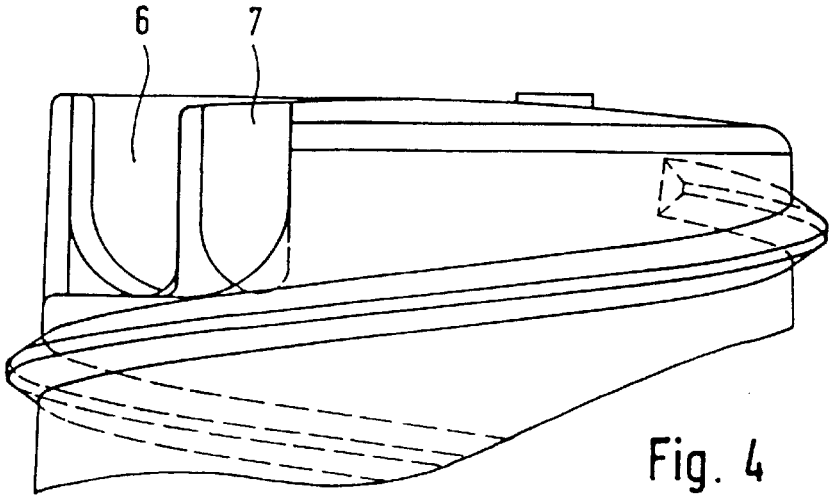
Figure 5:
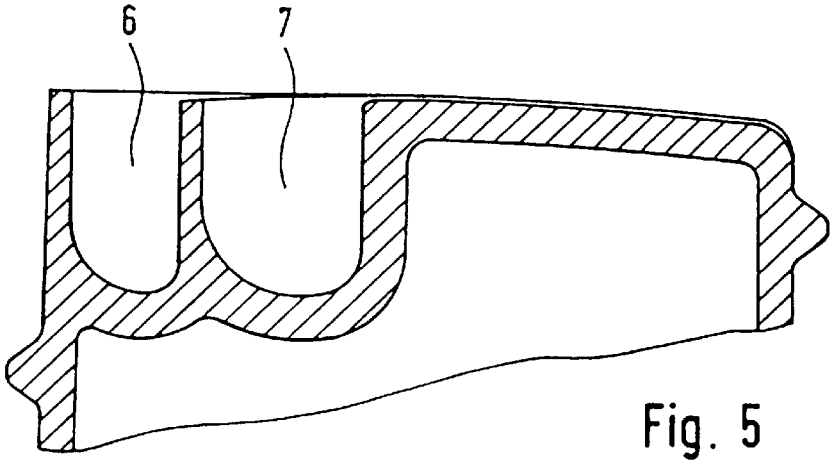
Figure 6:
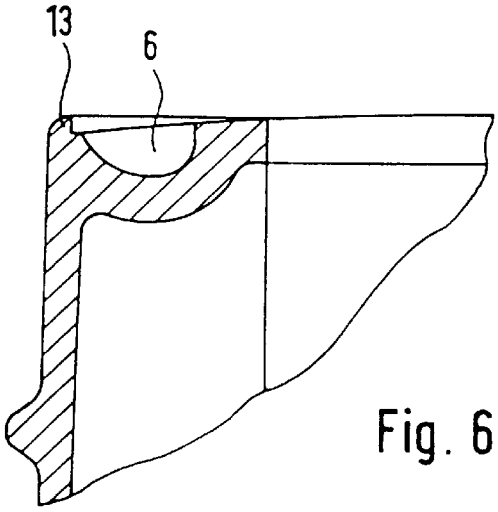

The present invention will be explained in greater detail below on the basis of one exemplary embodiment with reference to the drawings attached; in the drawings, FIG. 1 shows a schematic perspective view of a pot-shaped heat exchanger, with the housing being omitted, in the area joining a lower water pump, FIG. 2 shows a view of the bottom of the pot of the heat exchanger according to FIG. 1 viewed from the right, FIG. 3 shows a section through the arrangement according to FIG. 2 along line A—A, FIG. 4 shows view Y of the area of the bottom of the pot of the arrangement according to FIG. 2, FIG. 5 shows a section through the area of the bottom of the pot of the arrangement according to FIG. 2 along line B—B, and FIG. 6 shows a partial section along line C—C according to FIG. 2.

A heat exchanger 1 according to the drawing, in which the outer housing is omitted for better clarity of the illustration of the present invention, is pot-shaped, wherein the bottom 4 of the pot is a one-piece diecast part made of aluminum together with the jacket 5 of the pot. In particular, the heat exchanger 1 has a front-side connection 2, and a circumferential flange is formed, which is fastened in the mounted state of a heat exchanger arrangement to, e.g., a burner (not shown) such that the flame tube of the burner concentrically extends into the interior of the heat exchanger 1 according to FIG. 1, left. The end of the flame tube, not shown, which is the right-hand end according to FIG. 1, is open and is located at a distance from the bottom 4 of the pot.

On the underside, the bottom 4 of the pot has a lateral water inlet 3, into which the outlet end 15 of a water pump 14 extends, wherein the connection between the outlet end 15 of the water pump 14 and the lateral water inlet 3 of the bottom 4 of the pot is water-tight.

The jacket 5 of the pot has on its circumference a helical water guide 11 in order to establish a circulating flow of water along the jacket 5 of the pot during the operation of the heat exchanger, as is schematically illustrated by the arrow E in FIG. 1. The beginning 12 of the helical water guide 11 is located, according to FIG. 1, at the right upper end of the bottom 4 of the pot, while the end 16 of the helical water guide 11 is located in the area of the flange 17, which is fastened to the burner, not shown.

The water outlet in the area of the end 16 of the helical water guide is not shown in FIG. 1 for reasons of clarity. It does not affect the essence of the present invention.

The essence of the present invention is that water guide sections are provided in the bottom 4 of the pot for a directed, essentially surface-covering flow of water (or another liquid heat exchanger medium) over the bottom of the pot.

The water guide sections are, especially according to the exemplary embodiment shown in the drawing, a radially outer water guide channel 6 and a radially inner water guide channel 7, which are designed integrated with the bottom 4 of the pot in the form of depressions.

The two water guide channels 6 and 7 are shown in FIGS. 2 through 6 as an enlarged detail. They are sickle-shaped, wherein the length of the sickles extends over a pot bottom angle of about 100°, but other sickle lengths may also be provided if needed.

The radially outer water guide channel 6 has a flow cross section d that is smaller than the flow cross section D of the radially inner water guide channel 7. Depending on the needs of heat dissipation, other cross section ratios may be provided as well.

In the special exemplary embodiment shown in the drawing, the radially outer water guide channel 6 has a uniform width and extends in the immediate vicinity of the circular circumference of the bottom of the pot, where an axially projecting pot bottom edge 13, which is integrated within the bottom 4 of the pot and extends from the lateral water inlet 3 to the beginning 12 of the helical water guide 11, is also provided. The projecting pot bottom edge 13 acts as a water barrier during the operation, so that the water flowing in, being delivered by the water pump 14, is guided predominantly along the channels 6, 7 over the bottom 4 of the pot in a circulating manner before the circulating water of the bottom of the pot reaches the jacket 5 of the pot according to the arrow E after rotating by 360°.

The radial water guide channels 6, 7 have lateral water overflow side edges as well as a flat water outlet end 9 each at the end of the sickle, so that the water circulates not only directly in the channels 6 and 7, but also in the remaining flat areas of the bottom 4 of the pot after passing over laterally, and the latter circulation is supported by the main circulation in the water guide channels 6 and 7, i.e., the water is "carried away" in the flat areas of the bottom of the pot.

Consequently, a desired directed, essentially surface-covering flow of water is generated, on the whole, on the bottom of the pot, which prevents overheated areas from being present in the bottom 4 of the pot even when the heat exchanger 1 is operated at a high output, and vapor bubbles, which compromise the heat transfer efficiency, are not formed, either.

As is recognized from the exemplary embodiment shown in the drawing, the radially inner water guide channel 7 does not have a constant width, like the radially outer water guide channel 6, but it has an expansion, which is approximately kidney-shaped with the water outlet end 9 located there, in the middle area of the length of the sickle. It is achieved due to this expansion and the comparatively large flow cross section D of the radially inner water guide channel 7 compared with the smaller flow cross section d of the radially outer water guide channel that the angular velocity of all the circulating flow components of the water is approximately constant in the area of the bottom 4 of the pot. Depending on the needs of heat dissipation, flow components with different angular velocities may also be provided.

It shall also be mentioned that independently patentable features contained in the subclaims shall have a corresponding independent protection despite the formal reference made to the principal claim. All the inventive features contained in all the application documents also fall within the scope of protection of the present invention.

I claim:

1. A pot-shaped heat exchanger, comprising:

a jacket and a bottom;

a front-side connection to a burner for accommodating a burner flame tube, said front side connection being connected to said jacket at an end substantially opposite said bottom;

a lateral fluid inlet in said bottom and a fluid outlet in an area of said front-side connection, wherein fluid flows through both said bottom and said jacket; and fluid guide sections provided in said bottom for a directed, essentially surface-covering flow of fluid over said bottom.

2. The heat exchanger in accordance with claim 1, wherein said fluid guide channels are formed by at least one separate guide plate insert in said bottom, wherein said guide plate is sickle-shaped in the top view of the bottom of the pot and a root of the sickle is located approximately in an area of said lateral fluid inlet.

3. The heat exchanger in accordance with claim 2, wherein said radially outermost sickle-shaped fluid guide channel has a smallest flow cross section of all of said fluid guide channels.

4. The heat exchanger in accordance with claim 3, wherein said radially outermost sickle-shaped fluid guide channel has an essentially uniform width along a length thereof.

5. The heat exchanger in accordance with claim 3, wherein said flow cross section of said radially inwardly located fluid guide channels increases.

6. The heat exchanger in accordance with claim 1, further comprising a helical fluid guide in said jacket and a radially outermost pot bottom edge provided between said lateral fluid inlet and a beginning of said helical fluid guide.

7. The heat exchanger in accordance with claim 6, wherein said pot bottom edge is integrated into said bottom.

8. The heat exchanger in accordance with claim 6, wherein said pot bottom edge is a separate component.

9. The heat exchanger in accordance with claim 8, wherein a height of said pot bottom edge is adjustable.

10. The heat exchanger in accordance with claim 8, wherein one of a length of said pot bottom edge and an arc length of said jacket adjacent to said bottom is adjustable.

11. The heat exchanger in accordance with claim 1, wherein a length of a sickle of said fluid guide channels extends over an angle of about 100°.

12. The heat exchanger in accordance with claim 1, wherein said bottom is slightly arched outward.

13. The heat exchanger in accordance with claim 1, wherein the fluid guide sections have fluid barriers laterally at least partially.

14. The heat exchanger in accordance with claim 1, wherein said fluid guide sections have branching channels.

15. A pot-shaped heat exchanger, comprising:

a jacket and a bottom;

a front-side connection to a burner for accommodating a burner flame tube;

a lateral fluid inlet in said bottom and a fluid outlet in an area of said front-side connection, wherein fluid flows though both said bottom and said jacket; and fluid guide sections provided in said bottom for a directed, essentially surface-covering flow of fluid over said bottom, said fluid guide sections being provided at said bottom in an area joining said lateral fluid inlet and include at least two said fluid guide channels for a circulating flow of fluid, said fluid guide channels having a sickle-shape when viewed from a top of the pot-shaped heat exchanger.

16. The heat exchanger in accordance with claim 15, wherein said sickle-shaped fluid guide channels are integrated depressions provided in said bottom of said pot and a root of said sickle is located approximately in an area of said lateral fluid inlet.

17. The heat exchanger in accordance with claim 16, wherein said sickle-shaped fluid guide channels have flat fluid discharge ends.

18. The heat exchanger in accordance with claim 16, wherein said sickle-shaped fluid guide channels have said flat lateral fluid overflow edges.

19. The heat exchanger in accordance with claim 15, wherein said sickle-shaped fluid guide channel is located on an inside and extends through said an axial center of said heat exchanger or through a center of said bottom of said pot-shaped heat exchanger.

20. The heat exchanger in accordance with claim 15, wherein one of said sickle-shaped fluid guide channels is located radially on an inside and has an expansion along the sickle-shape, said expansion being kidney-shaped in a top view.

21. A pot-shaped heat exchanger, comprising:

a jacket having first and second opposite ends;

a bottom closing said first end of said jacket;

a burner connection at said second end of said jacket for accommodating a burner flame tube;

a lateral fluid inlet in said bottom and a fluid outlet in an area of said burner connection, wherein fluid flows through both said bottom and said jacket; and fluid guide sections provided in said bottom for generating a flow of fluid from said inlet to create an essentially surface-covering flow over said bottom.

* * * * *